US005079789A

United States Patent [19]

Jandrakovic

[11] Patent Number: 5,079,789

[45] Date of Patent: Jan. 14, 1992

[54] INVALID TURNING APPARATUS

[76] Inventor: Joyce A. Jandrakovic, 38630 Calumet Ave., Zephyrhills, Fla. 33540

[21] Appl. No.: 705,393

[22] Filed: May 25, 1991

[51] Int. Cl.[5] ..... A61G 7/10

[52] U.S. Cl. ..... 5/81 R; 108/142

[58] Field of Search ..... 5/81 R, 81 B, 86, 507, 5/508, 503; 414/921; 108/142

[56] References Cited

U.S. PATENT DOCUMENTS

| | | | |
|---|---|---|---|
| 1,731,308 | 10/1929 | Jordan . | |
| 2,757,388 | 8/1956 | Chisholm | 5/81 R |
| 2,842,413 | 7/1958 | Simmons . | |
| 2,963,713 | 12/1960 | Forrest | 5/81 R |
| 2,975,435 | 3/1961 | Forrest | 5/81 R |
| 3,112,500 | 12/1963 | MacDonald | 5/68 |
| 3,738,287 | 6/1973 | Gusdorf et al. | 108/150 |
| 3,911,509 | 10/1975 | Fleckenstein | 5/81 R |
| 4,279,043 | 7/1981 | Saunders | 5/81 R |
| 4,587,908 | 5/1986 | DeBruyn | 108/142 |
| 4,600,239 | 7/1986 | Gerstein et al. | 297/349 |
| 4,829,612 | 5/1989 | Adams | 5/81 R |
| 4,934,003 | 6/1990 | Hayakawa et al. | 5/81 R |

*Primary Examiner*—Alexander Grosz
*Attorney, Agent, or Firm*—Herbert W. Larson

[57] ABSTRACT

The apparatus is useful to turn an invalid patient ninety degrees from one resting position to a second resting position by standing the patient on a foot plate. A base platform supports the foot plate with a turntable mounted between the foot plate and base platform. A central bore in the foot plate, turntable and base platform permits a bolt to hold the foot plate, turntable and base platform together. An eccentric bore in the foot plate receives a long shafted bolt attached to the foot plate with a portion of the shaft descending below the foot plate to move within a groove in the base plate to permit about a ninety degree rotation of the foot plate.

7 Claims, 2 Drawing Sheets

INVALID TURNING APPARATUS

BACKGROUND OF THE INVENTION

This invention relates to an invalid turning apparatus. More particularly, it refers to a hand movable apparatus located on the floor next to an invalid's bed which permits a standing assisted invalid patient to be turned from one position next to the bed to another position for sitting, such as in a wheel chair.

Many different devices and apparatus exist to aid in the movement of an invalid patient. These include the devices shown in U.S. Pat. No. 2,963,713, wherein a platform swivels over a base plate so that an invalid can turn himself or herself while standing in an erect position. U.S. Pat. No. 4,600,239 describes, an automobile seat for handicapped persons ,which moves in a rotary manner. U.S. Pat. No. 4,934,003 describes a turntable assembly for moving a patient. None of these devices provide a simple portable means for a care provider to turn a patient in a standing position from a bed to a seat. Absent such a device, it is a strain on many care providers to move an invalid because of the weight involved. This can cause back strain or muscle pulls on the care provider. A device is needed which can allow a care provider to turn the invalid from a position adjacent a bed to a nearby wheelchair without causing exertion on the care provider

SUMMARY OF THE INVENTION

I have invented a simple portable apparatus for moving an invalid patient in an assisted standing position after leaving a bed to an adjacent wheelchair without causing a strain on the care provider assisting the patient.

My device has a foot plate on which the patient stands and a base platform with a curved groove for supporting the foot plate. A pair of plates having a set of ball bearings between them separate the foot plate and base platform. The top plate is attached to a bottom surface of the foot plate and the bottom plate is attached to a top surface of the base platform. The foot plate and base platform are bolted together through corresponding central bores. A bolt fitted through another eccentric bore in the foot plate rides in the base platform groove to provide about a ninety degree rotatable movement of the foot plate over the base platform. A patient standing on the foot plate can be assisted by the care provider to make a 90 degree turn from a bed to a wheelchair or vice-versa. The limited rotation is a safety feature to prevent the invalid person from falling.

BRIEF DESCRIPTION OF THE DRAWINGS

The invention may be best understood by those having ordinary skill in the art by reference to the following detailed description when considered in conjunction with the accompanying drawings in which.

DETAILED DESCRIPTION OF THE INVENTION

Figure 1:
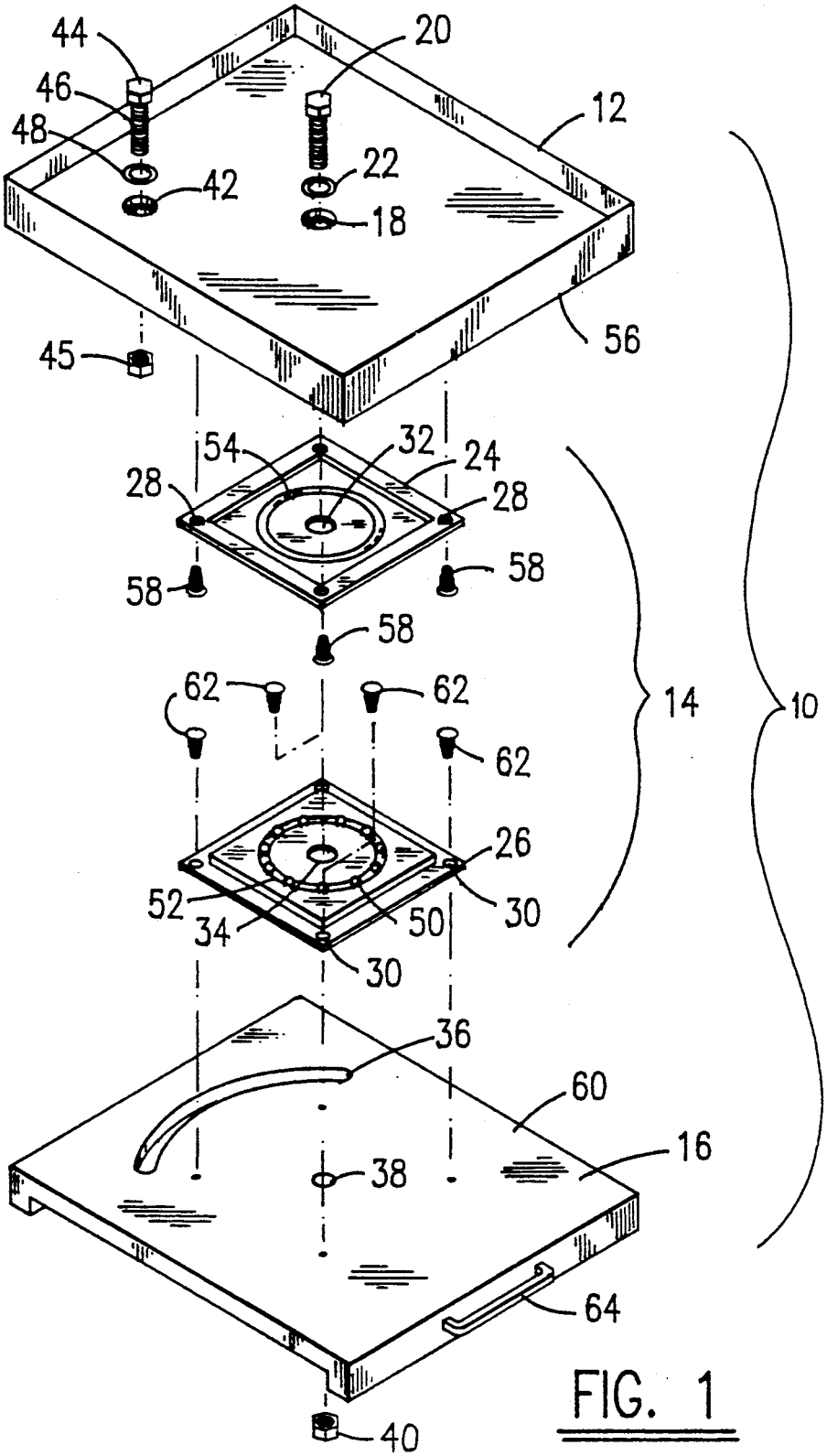
FIG 1 is an exploded view of the invalid turning apparatus of this invention.
Figure 2:
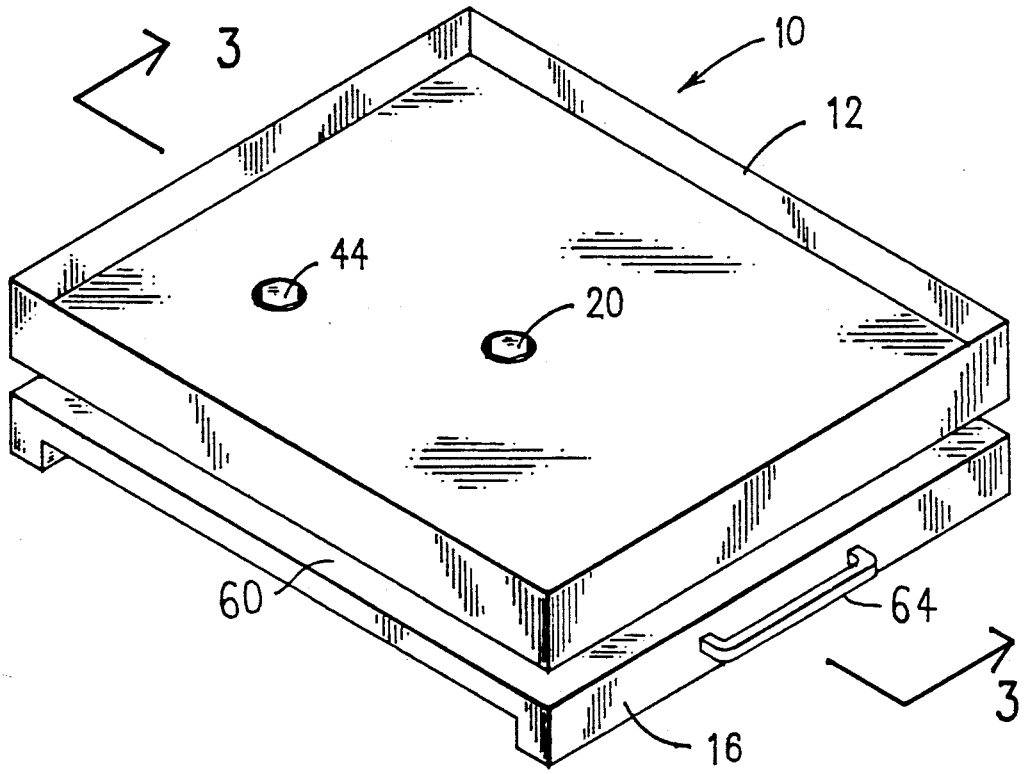
FIG. 2 is a perspective view of the invalid turning apparatus ready to be stepped on by a patient.
Figure 3:
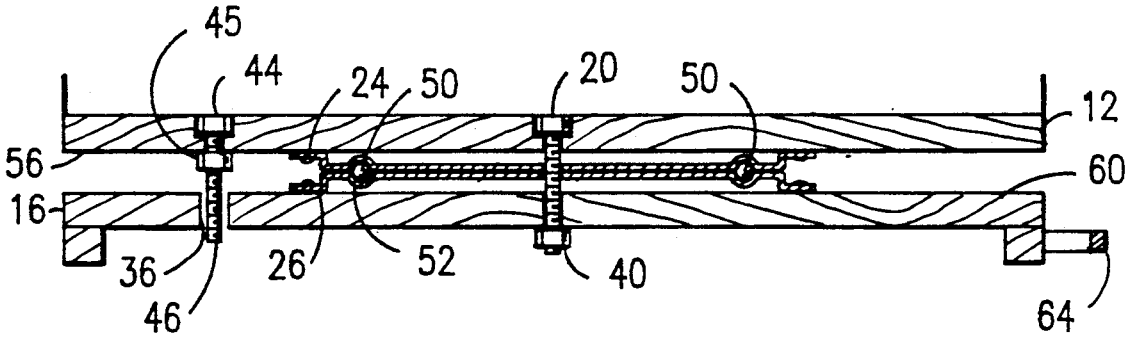
FIG. 3 is a sectional view of the apparatus along lines 3—3 of FIG. 2.

Throughout the following detailed description, the same reference numerals refer to the same elements in all figures.

Referring to FIG. 1, the invalid turning apparatus 10 has a top platform or patient foot plate 12, supported by a turntable 14 and a base platform 16 which sits on a substrate such as a floor.

The patient foot plate 12 is about eighteen inches square and has a central threaded bore 18 into which is inserted bolt 20. A washer 22 assists in seating bolt 20.

The turntable 14 has an upper plate 24 and a lower plate 26. These plates are both about eight inches square with peripheral bores 28 in plate 24 and bores 30 in plate 26. A central bore 32 in plate 24 and central bore 34 in plate 26 accommodate bolt 20. Ball bearings 50 seated in concave groove 52 in plate 26 are covered by convex groove 54 in plate 24 as viewed from a top plan view. Plate 24 is screwed into the bottom surface 56 of foot plate 12 by screws 58 and plate 26 is screwed into the top surface 60 of base platform 16 by screws 62.

The base platform 16 has a groove 36 encompassing about a one-quarter turn (about 90 degrees) around one side of the base platform. Central bore 38 receives bolt 20 and nut 40 below base platform 16 secures together the foot plate 12, turntable 14 and base platform 16.

The foot plate 12 has an eccentric bore 42 through which is inserted threaded bolt 44. Washer 48 and nut 45 hold the bolt 44 in place on foot plate 12. The shaft 46 of bolt 44 descending below plate 12 moves within groove 36 on base platform 16. For convenience, base platform 16 has a handle 64 for carrying the invalid turning apparatus 10.

The foot plate 12 and base platform 16 can be made of aluminum, wood, steel or a high strength polymer. The upper plate 24 and lower plate 26 are usually made of metal but could be made also from a high strength polymer to enclose the ball bearings 50.

In use, the invalid turning apparatus 10 is placed adjacent a chair or bed within a ninety degree turn either left or right from the invalid patient's position. The patient's feet are centered on the foot plate 12 and the care provider assists the patient in standing. With a gentle turn of the shoulders or waist the patient is easily turned ninety degrees to the desired receiving position.

Other equivalent materials can be substituted for the materials used in my invention to provide the same results in the same manner.

Having thus described the invention, what is claimed and desired to be secured by Letters Patent is:

1. An invalid turning apparatus, adapted to turn a standing invalid through about a ninety degree arc, comprising a base platform, a foot plate, adapted to support the feet of an invalid to be turned, in spaced parallel relation above the base platform, a turntable joining the foot plate to the base platform, a fastener connecting the base platform, foot plate and turntable, a curved groove forming about a ninety degree arc in the base platform through an upper and lower surface, a pin mounted through an eccentric bore in the foot plate descending downwardly into the groove of the base platform and the foot plate rotating in an arc corresponding to the arc of the groove in the base platform.

2. An invalid turning apparatus according to claim 1 wherein the base platform has a handle mounted on a side surface.

3. An invalid turning apparatus according to claim 1 wherein the turntable has an upper and lower plate, the upper plate having a convex inner circle corresponding to a concave inner circle of the lower plate as seen in a top plan view, multiple ball bearing. located in the circles between the upper and lower plates and the upper plate attached to a lower surface of the foot plate and the lower plate attached to the upper surface of the base platform.

4. An invalid turning apparatus according to claim 3 wherein a central bore in the foot platform, upper plate, lower plate and base platform receives a bolt to connect the foot platform, upper plate, lower plate and base platform.

5. An invalid turning apparatus according to claim 1 wherein the pin mounted through the foot plate is a threaded bolt attached by a nut to the foot plate with a shaft of the bolt descending into the groove of the base plate.

6. An invalid turning apparatus, adapted to turn a standing invalid through about a ninety degree arc, comprising a base platform having an upper surface a lower surface and two opposite side surfaces with a handle attached to one side surface, a foot plate, adapted to support the feet of an invalid to be turned, spaced apart above the base platform by a top and bottom plate, the top plate having a convex annular groove and the bottom plate having a corresponding concave annular groove as seen in a top plan view, multiple ball bearings located within an annular space formed by the top and bottom plates, a fastener passing through a central bore in the foot plate, the top plate, the bottom plate and the base platform to connect them together, a pin mounted through an eccentric bore in the foot plate descending downwardly into a groove forming about a ninety degree arc in the base platform so that the foot plate can rotate over the base platform.

7. An invalid turning apparatus according to claim 6 wherein the pin mounted through the eccentric bore in the foot plate is a bolt fastened to the foot plate with a descending shaft from the bolt engaging the groove in the base platform.

* * * * *